US011338538B2

(12) United States Patent
Beliveau et al.

(10) Patent No.: US 11,338,538 B2
(45) Date of Patent: May 24, 2022

(54) PROCESS FOR MANUFACTURING BAGS FOR PACKAGING ITEMS, AND BAG PRODUCED THEREFROM

(71) Applicant: LES EMBALLAGES TRIUM INC., Saint-Esprit (CA)

(72) Inventors: Daniel Beliveau, St-Charles Borromée (CA); Simon Coderre, Saint-Germain-de-Grantham (CA); Rick Rutherford, Drummondville (CA)

(73) Assignee: LES EMBALLAGES TRIUM INC., Québec (CA)

( * ) Notice: Subject to any disclaimer, the term of this patent is extended or adjusted under 35 U.S.C. 154(b) by 449 days.

(21) Appl. No.: 15/679,920

(22) Filed: Aug. 17, 2017

(65) Prior Publication Data

US 2018/0050510 A1 Feb. 22, 2018

Related U.S. Application Data

(60) Provisional application No. 62/376,002, filed on Aug. 17, 2016.

(51) Int. Cl.
*B31B 70/10* (2017.01)
*B31B 70/26* (2017.01)
(Continued)

(52) U.S. Cl.
CPC ..... *B31B 70/10* (2017.08); *B31B 70/005* (2017.08); *B31B 70/006* (2017.08); *B31B 70/18* (2017.08);
(Continued)

(58) Field of Classification Search
CPC ..... B31B 70/005; B31B 70/006; B31B 70/10; B31B 70/18; B31B 70/262; B31B 70/64;
(Continued)

(56) References Cited

U.S. PATENT DOCUMENTS 2,465,044 A * 3/1949 Shumann ..... B31B 70/00 493/235
2,494,965 A 1/1950 Rosen
(Continued)

FOREIGN PATENT DOCUMENTS

BE 772204 A 1/1972
CA 2 870 970 A1 10/2013
(Continued)

*Primary Examiner* — Robert F Long
*Assistant Examiner* — Eduardo R Ferrero
(74) *Attorney, Agent, or Firm* — Merchant & Gould P.C.

(57) ABSTRACT

A process is for manufacturing bags and a bag forming web. A bag is produced therefrom. The process includes conveying a continuous printed web including printed features along a conveying direction. The continuous printed web is cut into printed web sections along the conveying direction, and at least two of the printed web sections include(s) portion(s) of the printed features. The printed web sections are spaced-apart and a second continuous web is inserted between adjacent ones of the spaced-apart printed web sections, while an alignment between the printed web sections including printed features is maintained one relative to the other, along the conveying direction. The second continuous web is secured to the adjacent and spaced-apart printed web sections along longitudinal adjacent edges, thus forming a combined continuous bag forming web. Bags are formed from the combined continuous bag forming web, and the features on the different printed sections of the bags are in alignment.

13 Claims, 6 Drawing Sheets

(51) Int. Cl.

| | |
|---|---|
| ***B31B 70/18*** | (2017.01) |
| ***B31B 70/00*** | (2017.01) |
| ***B31B 70/64*** | (2017.01) |
| ***B31B 70/88*** | (2017.01) |
| *B31B 155/00* | (2017.01) |
| *B31B 150/00* | (2017.01) |
| *B31B 100/00* | (2017.01) |
| *B31B 70/16* | (2017.01) |

(52) U.S. Cl.
CPC ..... *B31B 70/262* (2017.08); *B31B 70/64* (2017.08); *B31B 70/88* (2017.08); *B31B 70/16* (2017.08); *B31B 70/26* (2017.08); *B31B 2100/0028* (2017.08); *B31B 2150/00* (2017.08); *B31B 2155/002* (2017.08); *B31B 2155/0014* (2017.08)

(58) Field of Classification Search
CPC .... B31B 2155/0012; B31B 2155/0014; B31B 2155/001; B31B 2155/002; B31B 2150/00; B31B 2100/0028; B31B 2160/102; B31B 70/26; B65D 75/522; B65D 65/18; B65D 33/04; B65D 71/38; B65D 33/01; B65D 2017/00845; B65H 21/02
See application file for complete search history.

(56) References Cited

U.S. PATENT DOCUMENTS 2,536,675 A * 1/1951 Bergstein ..... B31B 70/00 493/274
2,621,705 A * 12/1952 Nye ..... B29C 66/8223 156/515
2,735,630 A * 2/1956 Ziebolz ..... B21C 47/3416 242/563.1
2,873,566 A * 2/1959 Sylvester ..... B65D 31/00 53/452
2,990,875 A * 7/1961 Samuels ..... B29C 66/818 156/271
3,106,502 A * 10/1963 Levin ..... B29C 66/4312 156/251
3,153,481 A * 10/1964 Orsini ..... B31B 70/00 206/390
3,263,904 A * 8/1966 Warp ..... B65D 29/00 383/106
3,416,051 A * 12/1968 Pinto ..... B65H 23/1825 318/6
3,463,042 A * 8/1969 Goldman ..... B21D 28/002 83/627
3,509,799 A * 5/1970 Hartbauer ..... B29C 66/632 493/197
3,599,538 A * 8/1971 Piazze ..... B29C 65/18 493/194
3,656,415 A * 4/1972 Hook, Jr. ..... B31B 70/00 493/196
3,663,338 A * 5/1972 Wech ..... B31B 70/00 156/515
4,002,519 A * 1/1977 Moseley ..... B26D 7/1854 156/204
4,526,565 A * 7/1985 Hummel ..... B29C 53/10 493/196
4,579,278 A * 4/1986 Altus ..... B65D 65/18 229/87.06
4,932,932 A * 6/1990 Schmidt ..... B26D 1/225 493/200
5,170,058 A * 12/1992 Berasi ..... G03F 9/70 250/548
5,226,735 A 7/1993 Beliveau
5,244,450 A * 9/1993 Koehn ..... B31B 70/00 493/195
5,634,324 A * 6/1997 Schmachtel ..... B31B 50/00 53/546
5,806,284 A * 9/1998 Gifford ..... B26D 11/00 53/202
5,915,612 A * 6/1999 Hinton ..... G05B 19/251 226/100
5,983,594 A * 11/1999 Forman ..... B65D 33/1691 383/210
6,015,373 A 1/2000 Henderson et al.
6,030,120 A 2/2000 Fox et al.
6,149,565 A * 11/2000 Meyer ..... B31B 70/00 493/22
6,202,727 B1 3/2001 Yisha et al.
6,351,303 B1 * 2/2002 Thoms ..... G03B 27/32 250/548
6,416,220 B1 7/2002 Fox et al.
8,221,298 B2 * 7/2012 Pirtle ..... B65H 18/10 493/356
2001/0009090 A1 * 7/2001 Todd ..... B29C 65/18 53/64
2002/0107125 A1 5/2002 Voss
2003/0005662 A1 * 1/2003 Ishii ..... B65B 9/073 53/54
2004/0028268 A1 * 2/2004 Popp ..... G06T 7/70 382/141
2004/0030438 A1 * 2/2004 Popp ..... A61F 13/15772 700/122
2004/0133287 A1 * 7/2004 Gabler ..... G05B 19/4141 700/56
2004/0245270 A1 * 12/2004 Tan ..... B29C 66/1122 221/63
2005/0087578 A1 * 4/2005 Jackson ..... D06H 3/12 226/3
2005/0098457 A1 * 5/2005 Hamel ..... B32B 27/00 206/320
2005/0125180 A1 * 6/2005 Miller ..... A61F 13/15723 702/94
2005/0141760 A1 * 6/2005 Floeder ..... G01N 21/89 382/141
2005/0269386 A1 * 12/2005 Fisher ..... B65D 65/18 229/87.06
2006/0100082 A1 * 5/2006 Abe ..... B31B 70/00 493/374
2006/0211559 A1 * 9/2006 Howell ..... B65B 9/20 493/394
2006/0228058 A1 10/2006 Watterott et al.
2007/0005525 A1 * 1/2007 Collette, III ..... G05B 13/027 706/15
2007/0140597 A1 * 6/2007 Ozdeger Donovan ..... B65D 33/16 383/14
2008/0009400 A1 * 1/2008 Moody ..... B31B 70/00 493/23
2008/0151252 A1 * 6/2008 Clark ..... B31B 70/00 356/446
2009/0085507 A1 * 4/2009 Quan ..... B41F 13/0045 318/601
2009/0218247 A1 * 9/2009 Kalfon ..... B65D 33/04 206/459.1
2010/0024358 A1 2/2010 Meseguer Huertas
2010/0097462 A1 * 4/2010 Carlson ..... B65H 23/0216 348/143
2011/0060447 A1 * 3/2011 McLaughlin ..... A61F 13/15772 700/124
2011/0096356 A1 4/2011 Gianetti
2011/0257779 A1 * 10/2011 Theis ..... G05B 19/404 700/110
2014/0051560 A1 * 2/2014 Huffer ..... B29C 53/36 493/214
2014/0128235 A1 * 5/2014 Walsh, Jr ..... B65D 33/007 493/195
2014/0270590 A1 * 9/2014 Ostroy ..... B65D 33/2591 383/97
2014/0274629 A1 * 9/2014 Lykowski ..... B65B 57/04 493/17
2014/0349063 A1 11/2014 Frei et al.

(56) References Cited

U.S. PATENT DOCUMENTS

| | | | | |
|---|---|---|---|---|
| 2014/0364292 | A1 | 12/2014 | Tan | |
| 2015/0052857 | A1 | 2/2015 | Hefner et al. | |
| 2016/0228309 | A1* | 8/2016 | Ekstedt | A61F 13/5514 |
| 2017/0274611 | A1* | 9/2017 | Johnson | B31B 70/644 |
| 2017/0274613 | A1* | 9/2017 | Stafford, III | B31B 70/146 |

FOREIGN PATENT DOCUMENTS

| | | | |
|---|---|---|---|
| EP | 1 712 348 | B1 | 12/2007 |
| EP | 2 202 172 | A2 | 6/2010 |
| FR | 2 837 795 | | 10/2003 |
| WO | 2004/103841 | A1 | 12/2004 |
| WO | 2009/086604 | A1 | 7/2009 |
| WO | 2014/070232 | A1 | 5/2014 |

* cited by examiner

PROCESS FOR MANUFACTURING BAGS FOR PACKAGING ITEMS, AND BAG PRODUCED THEREFROM

CROSS-REFERENCE TO RELATED APPLICATIONS

This application claims priority under 35USC§ 119(e) of U.S. provisional patent application 62/376,002 filed on Aug. 17, 2016, the specification of which is hereby incorporated by reference.

TECHNICAL FIELD

The technical field generally relates to bags for packaging items, such as fruits and vegetables, and to processes for manufacturing such bags. More particularly, it relates to a process for manufacturing bags having sections with printed features between which another material is inserted and/or predetermined perforation patterns.

BACKGROUND

Bags used for the packaging of items, such as and without being limitative fruits and vegetables, may be required to include means to allow the clients to see the content of the bag. In some implementation, aeration of the items contained in the bag is also required to preserve the item freshness.

Paper bags having a window made of a mesh material have been widely used in the food packaging industry because they allow a customer to see the items contained in the bag and simultaneously provide aeration. However, these bags present the drawback allowing too much humidity to enter the bag, and lose their rigidity, running the risk of being torn when wet.

Bags made entirely of transparent plastic material allow overcoming the deficiencies of paper bags described above, and are easier to manufacture since they do not need to integrate a window. Some of the plastic bags also include ventilations holes, promoting air circulation within the bag. While such ventilated, transparent plastic bags are an improvement over paper bags, but they have the disadvantage of letting too much light in the bag, which can accelerate the degradation of fruits or vegetables contained in the bag, especially in the case of potatoes for example.

Plastic bags including an inner opaque layer of material have been developed to limit light from entering in the bag, as much as possible. These bags often include a window of transparent material that still allows clients to see, at least partially, the content of the bag. An example of such bag is described in U.S. Pat. No. 5,226,735.

There has been a need lately to provide bags for the food industry that are attractive and catchy for the clients, by including for example colorful designs. It remains a challenge to manufacture bags with printed features, especially when the printed features extend on different sections of the front and/or back walls, and when sections made of another material must be inserted between the printed sections of the bag.

More particularly, it remains a challenge to manufacture bags with printed features which are in alignment with each side of another bag section made of a different material, such as a window in the bag. It is also a challenge to maintain consistency and quality during the manufacturing of such bags, that is, to manufacture the bags such that the location of the design or features printed do not differ from one bag to the next during the manufacturing process.

SUMMARY

In accordance with one aspect, there is provided a process for manufacturing bags. The process includes steps of: conveying continuously a flexible and printed continuous web having a first opacity degree along a conveying direction; cutting the flexible and printed continuous web along a longitudinal axis, extending parallel to the conveying direction, to form at least two printed web sections, each one of the at least two printed web sections having at least one longitudinal inner edge, at least two of the printed web sections including a portion of the printed features requiring relative alignment; spacing apart the at least two printed web sections while maintaining an alignment between the at least two printed web sections along the conveying direction; inserting a flexible and transparent continuous web between adjacent ones of the at least two spaced-apart printed web sections while maintaining the relative alignment between the at least two printed web sections including the portion of the printed features requiring relative alignment along the conveying direction, the flexible and transparent continuous web sheet having a second opacity degree, less opaque than the first opacity degree; and securing longitudinal edges of the flexible and transparent continuous web to a respective one of the longitudinal inner edges of the adjacent spaced-apart printed web sections to form a combined continuous web. The process further include steps of cutting transversally the combined continuous web to define bag forming sheets; folding the bag forming sheets; and securing together at least two pairs of superposed free edges of the folded bag forming sheets to form a bag, the bag having a front wall and a back wall, a top edge, an opposed bottom edge and two spaced-apart longitudinal edges extending between the top and the bottom edges, the bag having an open mouth extending along the top edge and being closed along the bottom and longitudinal edges, the front and the back walls including printed bag sections, at least one of the front and back walls including one or more windows made from the flexible and transparent continuous web, with portions of the printed features on the printed bag sections being aligned on each side of the one or more windows.

In some embodiments, maintaining the alignment of the at least two printed sections including printed features is performed by adjusting tension applied to at least one of the printed web sections including printed features while being conveyed along the conveying direction and before securing the flexible and transparent continuous web to the at least two spaced-apart printed web sections.

In some embodiments, a first one of the at least two printed web sections including printed features includes a master eye mark and each one of the others printed web sections including printed features includes a slave eye mark.

In some embodiments, the flexible and printed continuous web includes a plurality of longitudinally spaced-apart reference marks and cutting the flexible and printed continuous web includes cutting the reference mark into the master eye mark localized on the first one of the at least two printed web sections including printed features and the at least one slave eye mark, each one being localized on another one of the at least two printed web sections including printed features.

In some embodiments, the process further includes printing the plurality of reference marks at predetermined intervals along the flexible and printed continuous web before cutting the flexible and printed continuous web.

In some embodiments, maintaining the alignment of the at least two printed sections includes detecting a position of the master eye mark and the at least one slave eye mark, comparing the position of the at least one slave eye mark with the position of the master eye mark and, if needed, adjusting the position of the at least one slave eye mark to be aligned with the master eye mark along the conveying direction.

In some embodiments, the process further includes perforating at least one of the flexible and transparent continuous web and the at least two printed web sections of the combined continuous web.

In some embodiments, perforating at least one of the flexible and transparent web and the at least two printed web sections includes: detecting at least one of the master eye mark and the at least one slave eye mark; and beginning perforation of the at least one of the flexible and transparent continuous web and the at least two printed web sections in accordance with a predetermined perforation pattern after at least one of a predetermined period of time and a predetermined spacing following detection of the at least one of the master eye mark and the at least one slave eye mark.

In some embodiments, the bag manufactured with at least one of the bag forming sheets is obtained from the process described above.

In accordance with another aspect, there is provided a process for manufacturing a bag forming web on a continuous production line. The process includes steps of: conveying a continuous printed web along a conveying direction, the continuous printed web including printed features requiring relative alignment; cutting the continuous printed web along the conveying direction into printed web sections wherein at least two of the printed web sections includes a portion of the printed features while continuously conveying the continuous printed web; spacing apart the printed web sections while continuously conveying the printed web sections; and while continuously conveying the continuous transparent web and the spaced-apart printed web inserting a second continuous web between adjacent ones of the spaced-apart printed web sections while maintaining alignment of the printed web sections including printed features requiring relative alignment one relative to the other along the conveying direction and securing the second continuous web to the adjacent and spaced-apart printed web sections along longitudinal adjacent edges, thus forming a combined continuous web.

In some embodiments, maintaining the alignment of the printed sections including printed features requiring relative alignment is performed by adjusting respective tensions applied to at least one of the printed web sections including printed features requiring relative alignment while being conveyed along the conveying direction and before securing the second continuous web to the spaced-apart printed web sections.

In some embodiments, a first one of the printed web sections including printed features requiring relative alignment includes a master eye mark and each one of the others printed web sections including printed features requiring relative alignment includes a slave eye mark.

In some embodiments, the continuous printed web includes a plurality of longitudinally spaced-apart reference marks and cutting the continuous printed web includes cutting the reference mark into the master eye mark localized on the first one of the printed web sections including printed features requiring relative alignment and the at least one slave eye mark, each one being localized on another one of the printed web sections including printed features requiring relative alignment.

In some embodiments, the process further includes printing the plurality of reference marks at predetermined intervals along the continuous printed web before cutting the continuous printed web.

In some embodiments, cutting the continuous printed web includes cutting the continuous printed web into n printed web sections, and m of the printed web sections include printed features requiring relative alignment and engaging at least m−1 of the printed web sections including printed features requiring relative alignment between pinch rollers.

In some embodiments, maintaining the alignment of the printed sections including printed features requiring relative alignment includes detecting a position of the master eye mark and the at least one slave eye mark, comparing the position of the at least one slave eye mark with the position of the master eye mark and, if needed, adjusting the position of the at least one slave eye mark to be aligned with the master eye mark along the conveying direction.

In some embodiments, detecting the position of the master eye mark and the at least one slave eye mark is performed with an eye mark detection unit including a photocells assembly.

In some embodiments, adjusting the position of the at least one slave eye mark includes adjusting a rotation speed of the pinch rollers engaging the respective one of the printed web sections including the at least one slave eye mark.

In some embodiments, the process further includes perforating at least one of the second continuous web and the printed web sections of the combined continuous web.

In some embodiments, perforating at least one of the second continuous web and the printed web sections includes: detecting at least one of the master eye mark and the at least one slave eye mark; and beginning perforation of the at least one of the second continuous web and the printed web sections in accordance with a predetermined perforation pattern after at least one of a predetermined period of time and a predetermined spacing following detection of the at least one of the master eye mark and the at least one slave eye mark.

In some embodiments, the step of conveying the continuous printed web along the conveying direction is performed at a conveying speed, and the process further includes adjusting the at least one of the predetermined period of time and the predetermined spacing in accordance with the conveying speed.

In some embodiments, the process further includes cutting transversally the combined continuous bag forming web to define bag forming sheets while continuously conveying the combined continuous web.

In some embodiments, the process further includes forming bags with the bag forming sheets by folding the bag forming sheets and securing together at least two pairs of superposed free edges of the folded bag forming sheets, each one of the bags including at least one second web portion between two printed web sections, the portions of the printed features being aligned on each side of the second web section.

In some embodiments, the process further includes steps of: unrolling the second continuous web along a second web conveying direction, the second web conveying direction defining an angle with the conveying direction; and while being conveyed continuously, reorienting the second continuous web along the conveying direction to insert the second continuous web inbetween adjacent ones of the printed web sections.

In some embodiments, the process further includes controlling a tension within the continuous printed web by continuously conveying the continuous printed web along the conveying direction and contacting at least one printed web roller having a controllable rotation speed.

In some embodiments, the continuous printed web has a first degree of opacity and the second continuous web has a second degree of opacity, which is less than the first degree of opacity.

In some embodiments, the second continuous web is a continuous transparent web.

In some embodiments, inserting the second continuous web between the spaced-apart printed web sections includes superposing the longitudinal adjacent edges of the second continuous web and the printed web sections and securing the second continuous web to the spaced-apart printed web sections along longitudinal adjacent edges includes heat sealing the spaced-apart printed web sections to the second continuous web along the longitudinal adjacent and superposed edges.

In some embodiments, the continuous printed web, the printed web sections, the second continuous web, and the combined continuous bag forming web are conveyed along the conveying direction at substantially a same conveying speed.

In some embodiments, the conveying speed is at least about 150 feet/minute.

In some embodiments, a bag is manufactured with at least one of the bag forming sheets obtained from the process described above.

In accordance with another aspect, there is provided a process for manufacturing a forming bag web on a continuous production line. The process includes steps of: conveying a first continuous web along a conveying direction; cutting the first continuous web along the conveying direction into first web sections; spacing apart the first web sections; inserting a second continuous web between the spaced-apart first web sections and securing the second continuous web to the spaced-apart printed web sections along longitudinal adjacent edges, thus forming a combined continuous bag forming web including a plurality of reference marks spaced-apart along the conveying direction; detecting the reference marks; and beginning perforation of the combined continuous bag forming web in accordance with a predetermined perforation pattern after at least one of a predetermined period of time and a predetermined spacing following detection of the reference marks.

In some embodiments, the step of conveying the first continuous web along the conveying direction is performed at a conveying speed, and the process further includes adjusting the at least one of the predetermined period of time and the predetermined spacing in accordance with the conveying speed.

In some embodiments, the first continuous web includes the plurality of reference marks.

In some embodiments, the process further includes printing the plurality of reference marks at predetermined intervals along the first continuous web before cutting the continuous printed web.

In some embodiments, cutting the first continuous web includes cutting the first continuous web into n first web sections and inserting a respective one of the second continuous web between adjacent ones of the first web sections.

In some embodiments, detecting the position of the reference marks is performed with an eye mark detection unit including a photocells assembly.

In some embodiments, the process further includes cutting transversally the combined continuous bag forming web to define bag forming sheets.

In some embodiments, the process further includes forming bags with the bag forming sheets by folding the bag forming sheets and securing together at least two pairs of superposed free edges of the folded bag forming sheets, each one of the bags including at least one second web portion between two first web portions.

In some embodiments, the first continuous web has a first degree of opacity and the second continuous web has a second degree of opacity, which is less than the first degree of opacity.

In some embodiments, the second continuous web is a continuous transparent web.

In some embodiments, inserting the second continuous web between the spaced-apart first web sections includes superposing the longitudinal adjacent edges of the second continuous web and the first web sections and securing the second continuous web to the spaced-apart first web sections along longitudinal adjacent edges includes heat sealing the spaced-apart first web sections to the second continuous web along the longitudinal adjacent and superposed edges.

In some embodiments, the first continuous web, the first web sections, the second continuous web, and the combined continuous bag forming web are conveyed along the conveying direction at substantially a same conveying speed.

In some embodiments, the conveying speed is at least about 150 feet/minute.

In some embodiments, a bag is manufactured with at least one of the bag forming sheets obtained from the process described above.

In accordance with another aspect, there is provided a bag for packaging fruits and vegetables. The bag includes: a front wall and a back wall, a top edge, an opposed bottom edge and two spaced-apart longitudinal edges extending between the top and the bottom edges, an open mouth extending along the top edge, the bag being closed along the bottom and longitudinal edges; at least one of the front and the back walls including at least two printed bag sections made from a flexible, printable material having a first degree of opacity, the two printed bag sections each including portions of a printed feature; and at least one of the front and back walls including one or more windows made from a flexible, transparent material having a second degree of opacity, which is less than the first degree of opacity, the one or more windows being located between the at least two printed bag sections, the portions of the printed features on the printed bag sections being aligned on each side of the one or more windows.

In accordance with another aspect, there is provided, a process for manufacturing bags on a continuous production line. The process includes steps of: conveying a first continuous printed web along a conveying direction, the first continuous printed web including a plurality of spaced-apart master eye marks; conveying a second continuous web along the conveying direction, the second continuous web including a plurality of spaced-apart slave eye marks; detecting a position of one of the master eye marks and one of the slave eye marks, comparing the position of the detected one of the slave eye marks with the position of the detected one of the master eye marks and, if needed, adjusting the position of the detected one of the slave eye marks to be aligned with the detected one of the master eye marks along the conveying direction; and securing the second continuous web to the first continuous web along longitudinal adjacent edges, thus forming a combined continuous web.

In some embodiments, adjusting the position of the detected one of the slave eye marks includes adjusting respective tension applied to the second continuous web while being conveyed along the conveying direction.

In some embodiments, adjusting respective tension applied to the second continuous web includes engaging the second continuous web between pinch rollers and controlling a rotation speed of the pinch rollers.

In some embodiments, the process further includes cutting transversally the combined continuous web to define bag forming sheets and forming bags with the bag forming sheets by folding the bag forming sheets and securing together at least two pairs of superposed free edges of the folded bag forming sheets, each one of the bags including a second web portion secured to a first web portion.

In some embodiments, a bag is manufactured with at least one of the bag forming sheets obtained from the process described above.

In accordance with another aspect, there is provided a process for manufacturing bags. The process includes steps of:

a) conveying a continuous printed web along a conveying direction, the continuous printed web including printed features;
b) cutting the continuous printed web along the conveying direction into printed web sections, portion of the printed features being divided on the printed web sections;
c) spacing apart the printed web sections;
d) inserting and securing a continuous transparent web between the spaced apart printed web sections, while maintaining alignment of the printed web sections one relative to the other along a direction orthogonal to the conveying direction, thus forming a combined continuous web, the continuous transparent web being used to create one or more windows in the bags; and
e) forming bags with the combined continuous web, each bag including at least one window between printed sections, the portions of the printed features being aligned on each side of the at least one window.

In some embodiments, the process further includes a step of i) conveying a continuous printable web while successively printing the printed features on the continuous printable web. The step i) is performed prior to step a).

In some embodiments, in step d), maintaining the alignment of the printed sections is achieved by adjusting respective tensions applied to the printed web sections after cutting the continuous printed web.

In accordance with another aspect, there is provided a process for manufacturing bags. The process includes steps of conveying a flexible, printable continuous web having a first opacity degree along a conveying direction; printing features on the flexible, printable continuous web, thus forming a printed continuous web; cutting the printed continuous web along a first axis parallel to the conveying direction to form at least two printed web sections, each one of the at least two printed web sections having a transversal inner edge, each one of the at least two printed web sections including a portion of the printed features; spacing apart the at least two printed web sections while maintaining an alignment between the at least two printed web sections along a second axis orthogonal to the conveying direction; inserting the flexible, transparent continuous web between the at least two spaced-apart printed web sections while maintaining the alignment between the at least two printed web sections along the second axis, the transparent continuous web sheet having a second opacity degree, less opaque than the first opacity degree; securing transversal edges of the flexible, transparent continuous web to a respective one of the transversal inner edges of the at least two-spaced-apart printed web sections; and forming bags, each bag having a front wall and a back wall, a top edge, an opposed bottom edge and two spaced-apart longitudinal edges extending between the top and the bottom edges, each bag having an open mouth extending along the top edge and being closed along the bottom and longitudinal edges, the front and the back walls including printed bag sections made from the at least two printed web sections, at least one of the front and back walls including one or more windows made from the flexible, transparent continuous web, with portions of the printed features on the printed bag sections being aligned on each side of the one or more windows.

In accordance with another aspect, there is provided a bag for packaging fruits and vegetables. The bag includes a front wall and a back wall, a top edge, an opposed bottom edge and two spaced apart longitudinal edges extending between the top and the bottom edges, an open mouth extending along the top edge. The bag is closed along the bottom and longitudinal edges. The bag also includes at least one of the front and the back walls including at least two printed bag sections made from a flexible, printable material having a first degree of opacity. The two printed bag sections each includes portions of a printed feature. The bag also includes at least one of the front and back walls including one or more windows made from a flexible, transparent material having a second degree of opacity, which is less than the first degree of opacity, the one or more windows being located between the at least two printed bag sections, the portions of the printed features on the printed bag sections being aligned on each side of the one or more windows.

Other features and advantages of the invention will be better understood upon reading of embodiments thereof with reference to the appended drawings.

DETAILED DESCRIPTION

Figure 1:
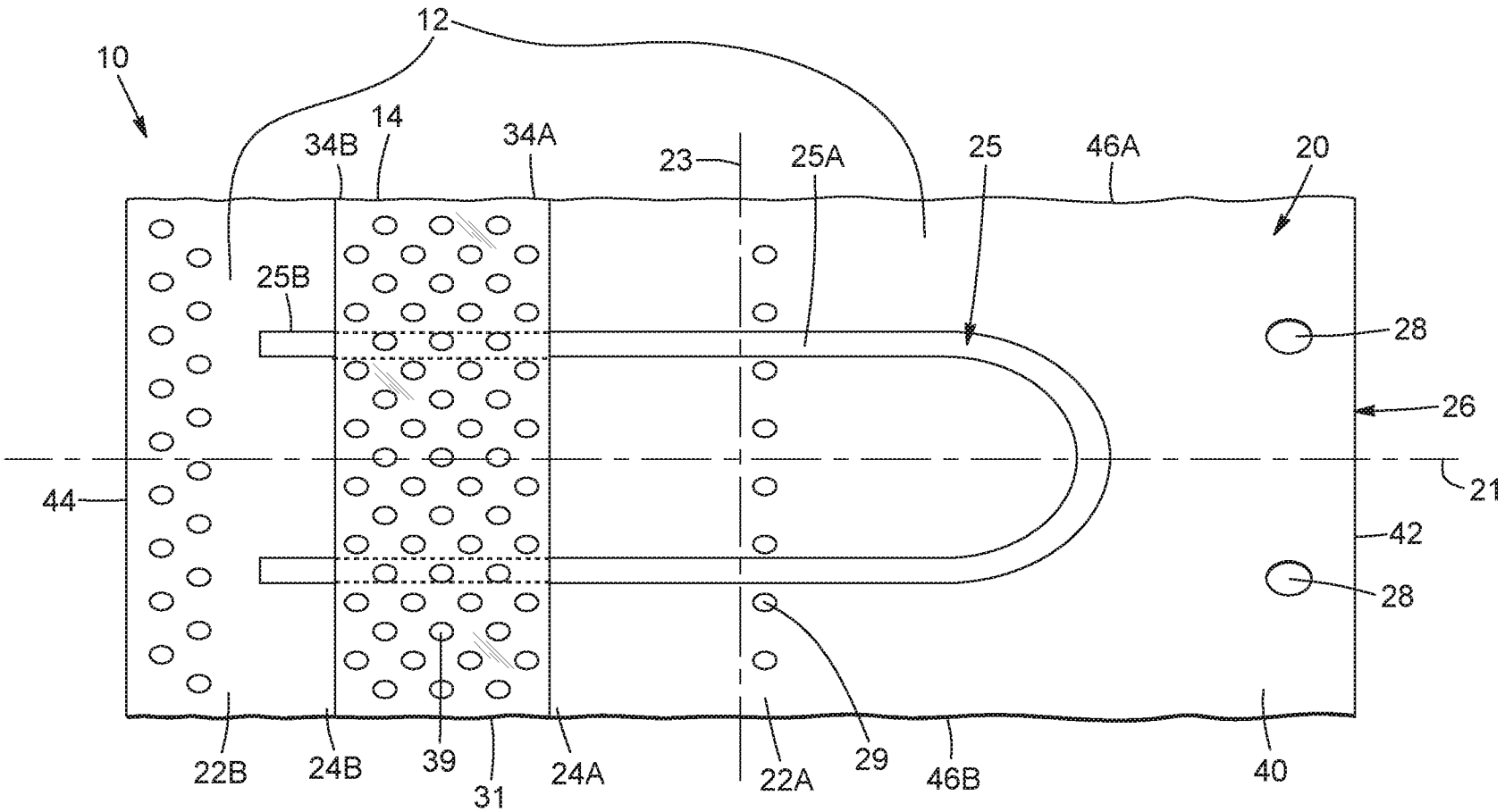
FIG. 1 is a front elevation view of a bag for packaging products, showing a front wall thereof, according to an embodiment.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale and that the emphasis is instead being placed upon clearly illustrating the elements and structures of the present embodiments.

Moreover, it will be appreciated that positional descriptions such as "top", "bottom", "under", "left", "right", "front" and "rear" and the like should, unless otherwise indicated, be taken in the context of the figures and should not be considered limiting.

Bags for Packaging Products Such as Fruits and Vegetables

Generally described, a manufacturing process to produce bags for packaging products is provided, as well as a bag resulting from the manufacturing process. The bag is of the type being made from at least two different types of webs or films. A first web is typically a flexible, printable web used to create the printed sections of the bag, and a second web has a lower opacity relative to the first web, so as to create window(s) in the bag. Once the bag is formed, it can include two or more printed sections, and one or more intermediate sections, which can form (a) window(s) in the bag. The one or more intermediate sections can be located between two adjacent printed sections. For instance, in an embodiment, the printed features therefor extend on the printed sections, and should be aligned on each side of the window(s).

Bags with Relative Alignment of Printed Features

Figure 2:
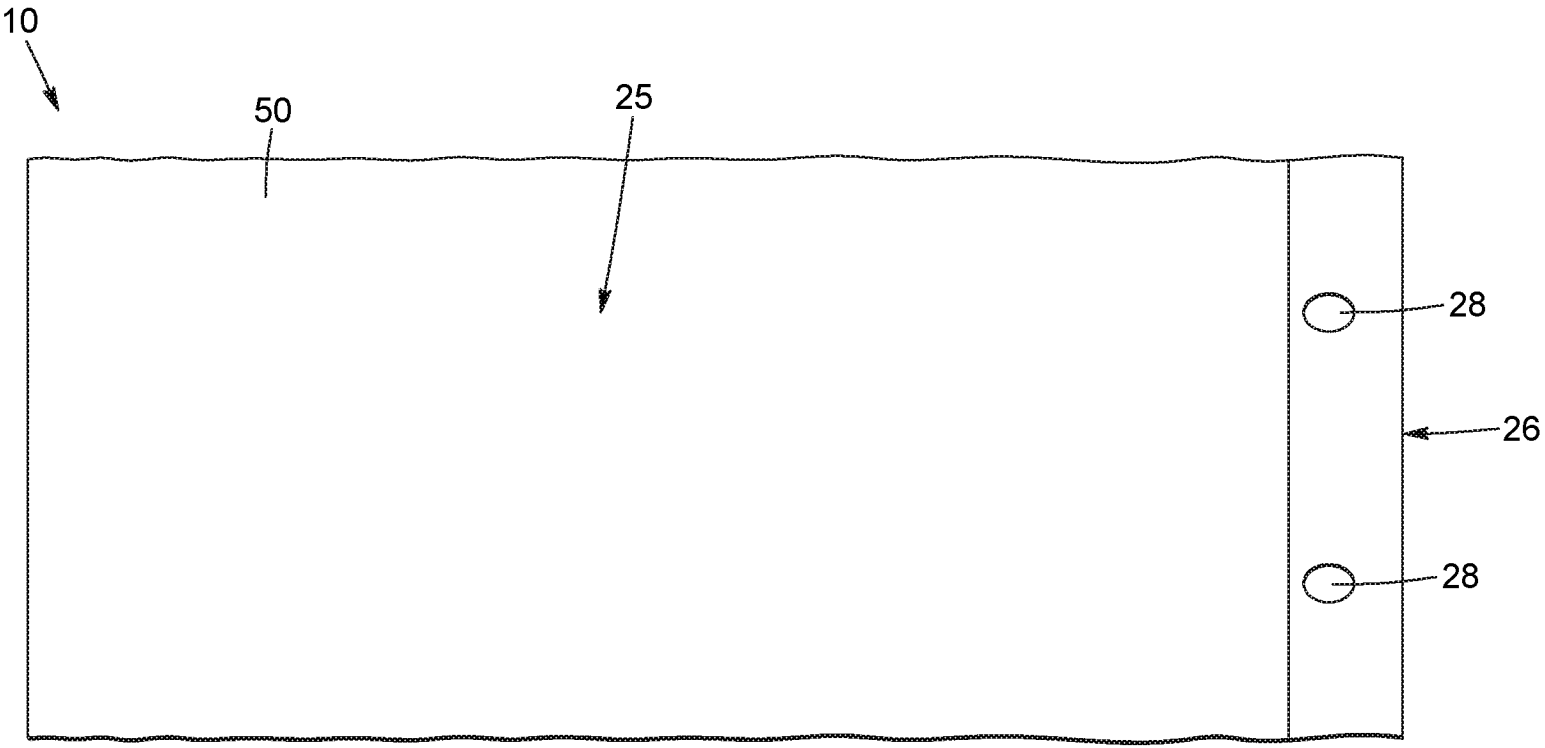
FIG. 2 is a rear elevation view of the bag shown in FIG. 1, showing a back wall thereof.

Referring to FIGS. 1 and 2, an embodiment of a bag 10 for packaging products is shown. The illustrated embodiment includes printed features requiring relative alignment and so will be referred to as "bags with printed features" (by opposition to "bags without printed features" which will be described later).

The bag 10 has a front wall 40 (shown in FIG. 1) and a back wall 50 (shown in FIG. 2), a top edge 42, a bottom edge 44, and two spaced-apart longitudinal edges 46A, 46B. The front wall 40 and the back (or rear) wall 50 may also be referred as "front side" and "back side", respectively. In the illustrated embodiment, the front and back walls 40, 50 are made of a single bag forming sheet 20, which is folded longt the bottom edge 44 of the bag, and closed on along the longitudinal edges 46*a*, 46*b*, thus creating an open mouth 26 at the top edge 42 of the bag 10. In other embodiments, it is possible to form the front and back walls 40, 50 from two (or more) different sheets, corresponding to the front and back walls, the two (or more) sheets being closed or secured along the bottom and longitudinal edges 44, 46*a*, 46*b*. It would also be possible to fold a sheet along one of the longitudinal edge (e.g. 46*a*), and seal the other one of the longitudinal edge (e.g. 46*b*), as well as the bottom edge 44.

Figure 5:
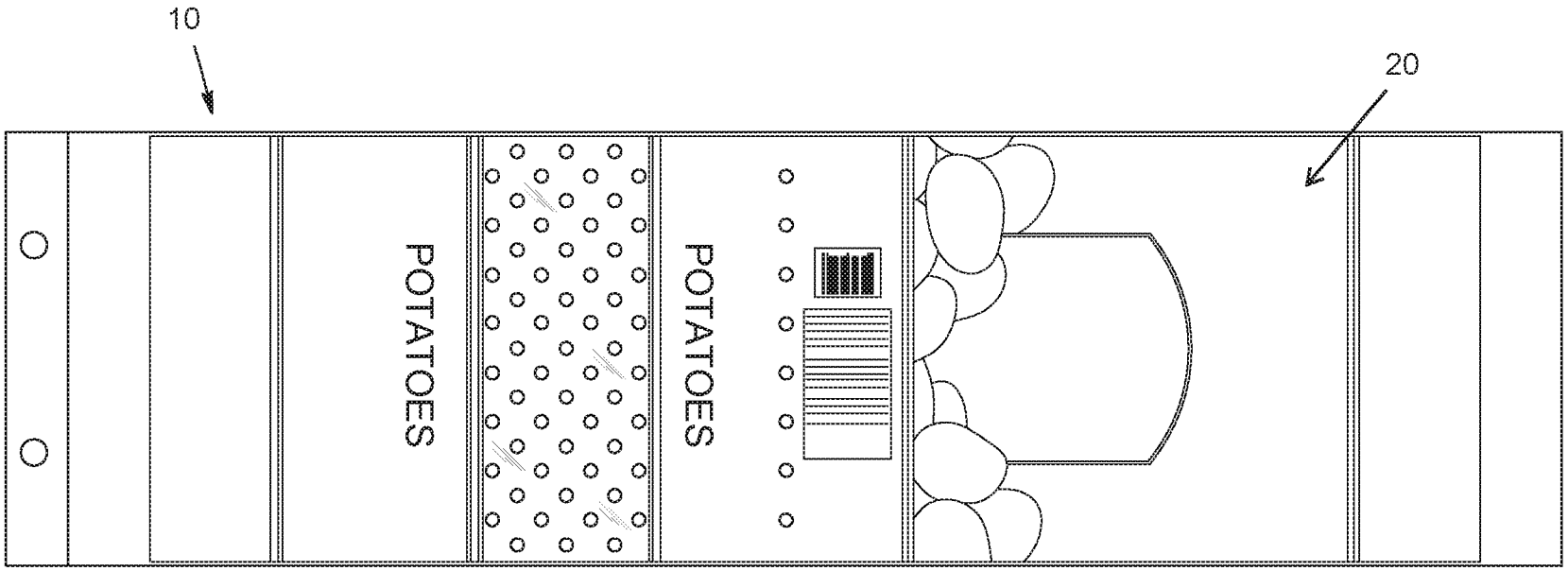
FIG. 5 is a top plan view of a bag forming sheet for forming a bag for packaging products, according to another possible embodiment, wherein the bag forming sheet includes aligned printed features on two spaced-apart printed web sections and a perforation pattern in a window section extending between the two printed web sections.

The one or more bag forming sheets 20 include(s) one or more different sheet segments, which are made of different materials. In the illustrated embodiment, the sheet 20 includes a first sheet material 12 which forms the back wall 50 and most of the front wall 40, and a second sheet material 14, located on the front wall 40 of the bag 10. The first sheet material 12 is divided into two segments, spaced-apart by the second sheet material 14. The first sheet material 12 can also be referred to as a "printable sheet material" 12 and the second sheet material 14 can also be referred as a "window material" 14, as will be explained in greater detail below. It will be noted that not all of the surface of the printed sheet material needs to be printed, but in the embodiment described herein, it includes at least portions or areas provided with printed designs or features. In the illustrated embodiment, the printed sheet material 12 only includes printed features 25 on the area forming the front wall 40, and not on the back wall 50. Of course, both the front and back walls 40,50 can include printed features, such as shown in FIG. 5 for example. In other embodiments, it is possible that both the front and the back walls 40, 50 include one or more window segments. In other words, the front and/or back walls 40, 50 can include more than two printed sheet segments, and the front and/or back walls 40, 50 can include more than one window segment.

The material used in the composition of the first (or printed) sheet segment is a flexible and printable plastic. This material used for the first sheet segment can also be referred to as "first material", "printable material" or "printed material" (when printed features are provided thereon). The first material can include plastic or any other suitable material having the required structural and mechanical properties, and which is suitable for printing. The printable material is typically a thermoplastic polymer. In the embodiment illustrated in FIG. 1, the printed sheet segment 12 includes three layers of coextruded polyethylene. Of course, a different number of layers may be used, depending on the application for which the bag is to be used. An additive for changing the opacity degree of one or more of the layers can be added to the polyethylene. As a result, the printed sheet segment 12 has a given degree of opacity. Possible additives that can be added to the thermoplastic polymer include titanium dioxide and carbon black. The opacity degree of the printed sheet segment can be such that substantially no light can be transmitted inside of the bag 10.

Other types of thermoplastic polymer can be used in the composition of the printed sheet segment(s). For example, the printable material can include polylactic acid, polypropylene, polystyrene, polyvinyl chloride or polyethylene. In embodiments where the printed sheet segment is made of a plurality of layers, the layers can be made of the same thermoplastic polymer or of different types of thermoplastic polymers, to form a coextruded film.

Now turning to the material used for the second sheet material (i.e. the "window material"), it can be selected with a lower opacity degree relative to the one of the printable material used for the printed sheet segment, thus creating a window 31 in the bag, allowing consumers to see the content of the bag when filled. The window 31 herein refers to a substantially transparent panel admitting the passage of the light (i.e. a form of radiations). The expression "transparent" is understood as the property of the window 31 of transmitting at least a portion of light without appreciable absorption or scattering of the light.

The sheet 20 is thus made from the combination of at least two different materials. The materials chosen to form the bag can be selected with different degrees of opacity, depending on the application for which the bag is used. The material used in the composition of the window segment (which can be referred to as "second material") is also a flexible plastic and in several embodiments, it will be a transparent material, as it has been described above. Of course, it is possible for the window segment to be printed as well, and to be formed from one or more layers.

It should be noted that the first and second sheet segments (which in the illustrated embodiment of FIG. 1 correspond to the printed sheet segment 12 and the window segment 14) can be made of the same thermoplastic polymer, using different compositions. For example, the printable material (forming the printed sheet segment 12) and the transparent material (forming the window segment 14) may include different additives, meaning that while they are both made from the same thermoplastic polymer, they can be considered as "different materials", because they have different properties (e.g. opacity, additives content, or the like).

Referring to the embodiment shown in FIG. 1, printed features 25 are printed on an outer side (i.e. the side facing the environment of the bag, by opposition to the inner side of the bag, which corresponds the side facing the internal portion or the content of the bag) of the printed sheet segment 12, on the front wall 40. The printed sheet material 12 defines two printed sections 22A, 22B, each including a portion 25A or 25B of the printed features 25. As will be explained in greater detail below when describing the manufacturing process, the printed features 25 may be first printed on an outer side of a printable web. Once printed, the web may be cut into two printed web sections, which will eventually form the two printed sections 22A, 22B of the bag, with the printed features 25 being also divided into two portions 25A, 25B. In this scenario, each portion 25A, 25B of the design or printed features 25 is thus provided on a respective section 22A, 22B of the bag. The window material 14, which is also a window segment, is inserted between the two printed sections 22A, 22B of the printed sheet 12, and when the window segment 14 is secured to the printed sections 22A, 22B of the sheet segment 12, the portions 25A, 25B of the printed features 25 should remain in substantial alignment along a transversal axis 23 of the bag 10. In other words, the two portions 25A, 25B should be centered one with respect to another and/or are aligned with one another, on both sides of the window 31. Thus, the relative configuration of the printed features should substantially remain in their original configuration, i.e. cutting a web into two printed sections 22A,22B. Such alignment is made possible thanks to the manufacturing process which will be in greater detail later below.

In the non-limitative illustrated embodiment, the printed feature is a "U" shape having a first portion 25A, in this case the bottom, curved side of the "U", printed on the first section 22A, and a second portion 25B, in this case the top side of the "legs" of the U, extending on the second section 22B of the bag. Both portions of the printed features are thus aligned along the transversal axis 23 on each side of the window 31, as shown by striped lines. The printed feature 25 looks to be continuous across the window 31, and is centered relative to the longitudinal edges 46A, 46B of the bag. It will be noted that a design should not necessarily be split on either side of the window. In some embodiments, the printed features include text and/or images on one side of the window 31 and unrelated text and/or images on the other side of the window 31. In such a case, it is necessary that the printed text and images on both sides of the window remain centered relative to the longitudinal edges 46A, 46B of the bag 10.

Still referring to FIGS. 1 and 2, in addition to the transversal axis 23, the bag 10 has a longitudinal axis 21. Each one of the printed sections 22A, 22B has a transversal inner edge 24A, 24B, with both edges 24A, 24B bordering the window sheet 14. The window sheet 14 has two transversal edges 34A, 34B. The window sheet 14 is thus located between the two sections 22A, 22B of the flexible sheet 20, each of the transversal edges 34A, 34B of the window sheet 14 being secured to a respective one of the transversal inner edges 24A, 24B of the printed sections 22A, 22B.

Optionally, the bag 10 may further include a plurality of perforations 29, 39 provided on the front wall and/or back wall 40, 50. More particularly, the perforations 29, 39 can be distributed across surface of the flexible bag forming sheet 20, surface of the printable material 12 and/or surface of the flexible window 31. The perforations 29, 39 help promoting air circulation within the bag 10. In an embodiment, the perforations are configured in accordance with a predetermined perforation pattern. Placement of the perforations 29, 39 is such that they are not located at or near a seal closing one side of the bag 10, which would weaken the resulting bag 10. In this sense, each seal is "hermetic", because it contains no aeration perforation. The bag 10 may also include at least one optional wicket hole 28 located close to the open mouth 26 for hanging the bag 10. In the illustrated embodiment, two wicket holes 28 are laterally aligned, parallel to the transversal axis 23. Alternatively, the bag 10 can comprise any number of wicket holes 28.

Although the embodiments of the bag 10 include certain geometrical configurations as explained and illustrated herein, not all these geometrical configurations are essential and hence should not be taken in their restrictive sense, as can be easily inferred herefrom by a person skilled in the art. Moreover, it will be appreciated that geometrical configurations or illustrated details with regard on the dimensions of the bag 10, shape of the bag 10, number of windows and/or printed sections of the bag 10, location and number of perforations 29, 39, and the like should be taken in the context of the figures and should not be considered limiting.

Bags without Relative Alignment Printed Features

Figure 6:
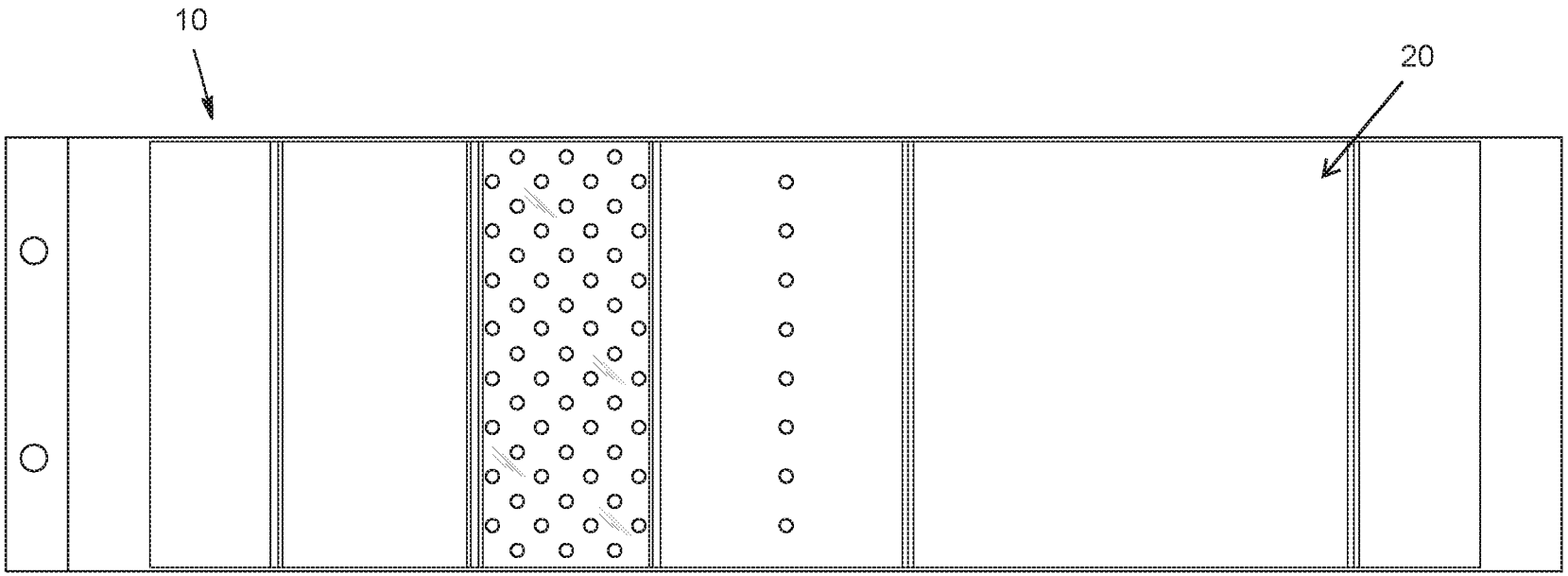
FIG. 6 is a top plan view of a bag forming sheet for forming a bag for packaging products, according to another possible embodiment, wherein the bag forming sheet includes solely a perforation pattern, i.e. the bag is free of aligned printed features.

Now referring to FIG. 6, it is also possible to manufacture a bag 10 without relative alignment of printed features. While this bag is manufactured with a different manufacturing process than the bag with printed features, the two bags are similar. In some embodiments, the bags share some common characteristics and properties, and may for example solely differ by the presence (or absence) of aligned printed features.

Similarly to the bag described with reference to FIGS. 1,2 and 5, the bag 10 without printed features has a front wall and a back wall, a top edge, a bottom edge, and two spaced-apart longitudinal edges. The front and back walls may be made of a single bag forming sheet, which is folded at the bottom edge of the bag, and closed on along the longitudinal edges, thus creating an open mouth at the top edge of the bag.

The bag 10 illustrated in FIG. 6 may comprise one or more different sheet segments, which are made of different materials. In the illustrated embodiment, the sheet 20 includes a first sheet material which forms the back wall and most of the front wall, and a second sheet material, located on the front wall of the bag 10.

The material used for forming the bag 10 may be a thermoplastic polymer (e.g. three layers of coextruded polyethylene) for the first sheet material. Other types of thermoplastic polymer can be used in the composition of the first sheet material. For example, the first sheet material can include polylactic acid, polypropylene, polystyrene, polyvinyl chloride or polyethylene. In embodiments where the first sheet material is made of a plurality of layers, the layers can be made of the same thermoplastic polymer or of different types of thermoplastic polymers, to form a coextruded film. The material used for the second sheet material may be selected with a lower opacity degree relative to the one of the first sheet material.

It should be noted that the first and second sheet segments can be made of the same thermoplastic polymer, using different compositions. For example, the first sheet material and the second sheet material may include different additives, meaning that while they are both made from the same thermoplastic polymer, they can be considered as "different materials", because they have different properties (e.g. opacity, additives content, or the like).

The bag 10 may further include a plurality of perforations provided on the front wall and/or back wall. In an embodiment, the perforations are configured in accordance with a predetermined perforation pattern. Placement of the perforations is such that they are not located at or near a seal closing one side of the bag 10. In this sense, each seal is "hermetic", because it contains no aeration perforation. The bag 10 without printed feature may also include at least one optional wicket hole located close to the open mouth for hanging the bag 10. The bag, either the first or second sheet segments, can include printed features which are not compulsorily aligned on two bag sections.

Process for Manufacturing Bags

In accordance with another aspect, the process for manufacturing bags as described above will be explained, with reference to FIGS. 3 and 4. The process is a continuous manufacturing process carried out on a continuous production line.

Printed Features Alignment and Perforations Implementations

Figure 3:
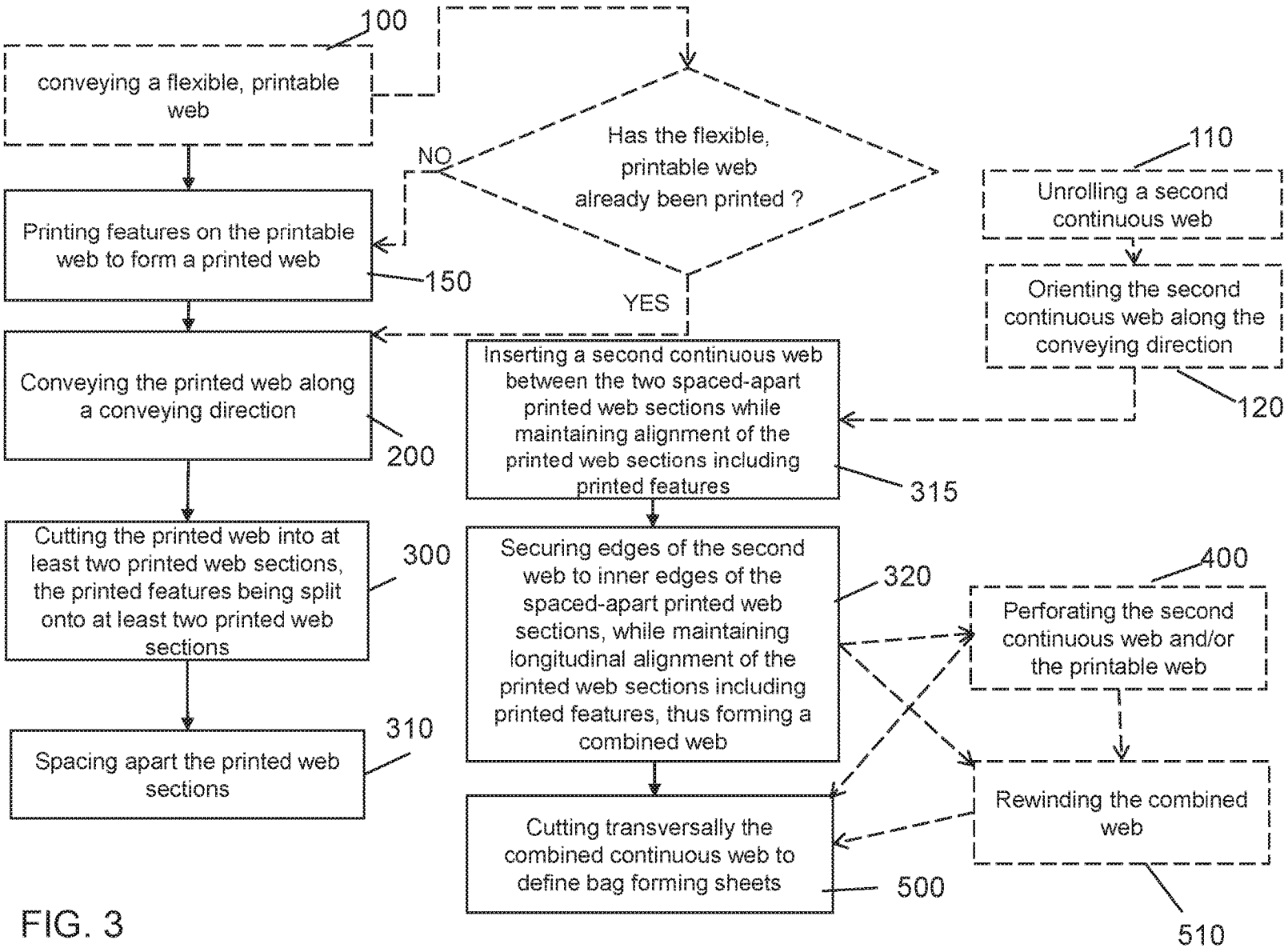
FIG. 3 is a flowchart of a process for manufacturing bags for packaging products, according to different possible embodiments.

Referring to FIG. 3, the manufacturing process includes the general steps of conveying a continuous printed web (also referred to as the "printed web" or "first continuous web") along a conveying direction. In an embodiment, the printed web can have printed features provided thereon (the features are printed at step 150); cutting the printed web into two or more printed web sections along the conveying direction, the printed features being split between the two or more printed web sections (step 300); spacing apart transversally the printed web sections (step 310); inserting a second continuous web between each pair of adjacent ones of the printed web sections while maintaining an alignment (or "maintaining registration") of the two or more printed web sections including printed features, along the conveying direction (or longitudinally) (step 315); securing the second continuous web to the spaced-apart printed web sections along longitudinal adjacent edges, thus forming a combined continuous web (step 320); and cutting transversally the combined continuous web to define bag forming sheets 20 (step 500). The bag forming may then be used to form bags out the of the combined web, each bag including one or more windows, with portions of the printed features being aligned on each side of the window(s) (step 500).

During each one of the steps, the continuous printed web, the printed web sections, the second continuous web, and the combined web are conveyed substantially continuously along the production line.

As mentioned above, the steps described above are performed on a continuous production line. The "continuous printed web" and the "continuous transparent web" can also be referred as flexible webs, or films, which are typically provided on rolls, and which are continuously unwound and conveyed along the conveying direction (or travel direction), which corresponds to a longitudinal axis of the webs. While the term "continuous" might be omitted in the description below, to lighten the text, "webs" are typically long and continuous films which can be conveyed, wound and unwound.

As mentioned above, in an embodiment, the "second web" can be a transparent web. It does not necessarily need to be fully transparent: what is needed is for the "transparent web" to be less opaque than the printed web, so as to create one or more windows in the bag, allowing consumers to see at least a portion the content of the bag.

In addition, the "printed web" does not need to be entirely covered with printed features. In this regard, it is possible for the "printed web" to only include printed features on a portion of one of its surfaces (e.g. its outer surface). Once the printed web and second web (or portions thereof) are combined, they form the continuous web. The continuous web can be cut to form the bag forming sheets 20 used to form the bag. The assembly of the bag can be performed on a continuous production line within the same process, but could also be performed "off-line", in a different manufacturing process. In this case the combined web can be rewound on a roller, so that the combined web can be cut, folded and sealed to form bags on another manufacturing line.

As shown in FIG. 3, at the beginning of the process, the printed web may have been previously printed, off-line, and provided in rolls which are unwound and conveyed for the next steps of the process. Alternatively, a flexible, a printable web may first be provided (step 100) and successively printed with features to form the printed web (step 150). In this case, the printing step is performed in-line, upstream of the cutting step 300.

The second web is also typically provided in rolls, and unrolled (step 110) in view of the insertion step (315). If needed, the second web can be reoriented (step 120), so that it is eventually conveyed along the same conveying direction than the printed web (i.e. the printed web and the second web are conveyed along substantially parallel conveying directions). For the insertion step 315, the second web can be conveyed above or below the printed web. Optionally, the printed web and/or the second web can be perforated (step 400). The perforation step can occur after having secured the second web between the printed web sections. It is also possible that the second web be pre-perforated, before being combined with the printed web. It is also possible to perforate the printed web sections, in advance or as part of the in-line combined process.

Figure 4:
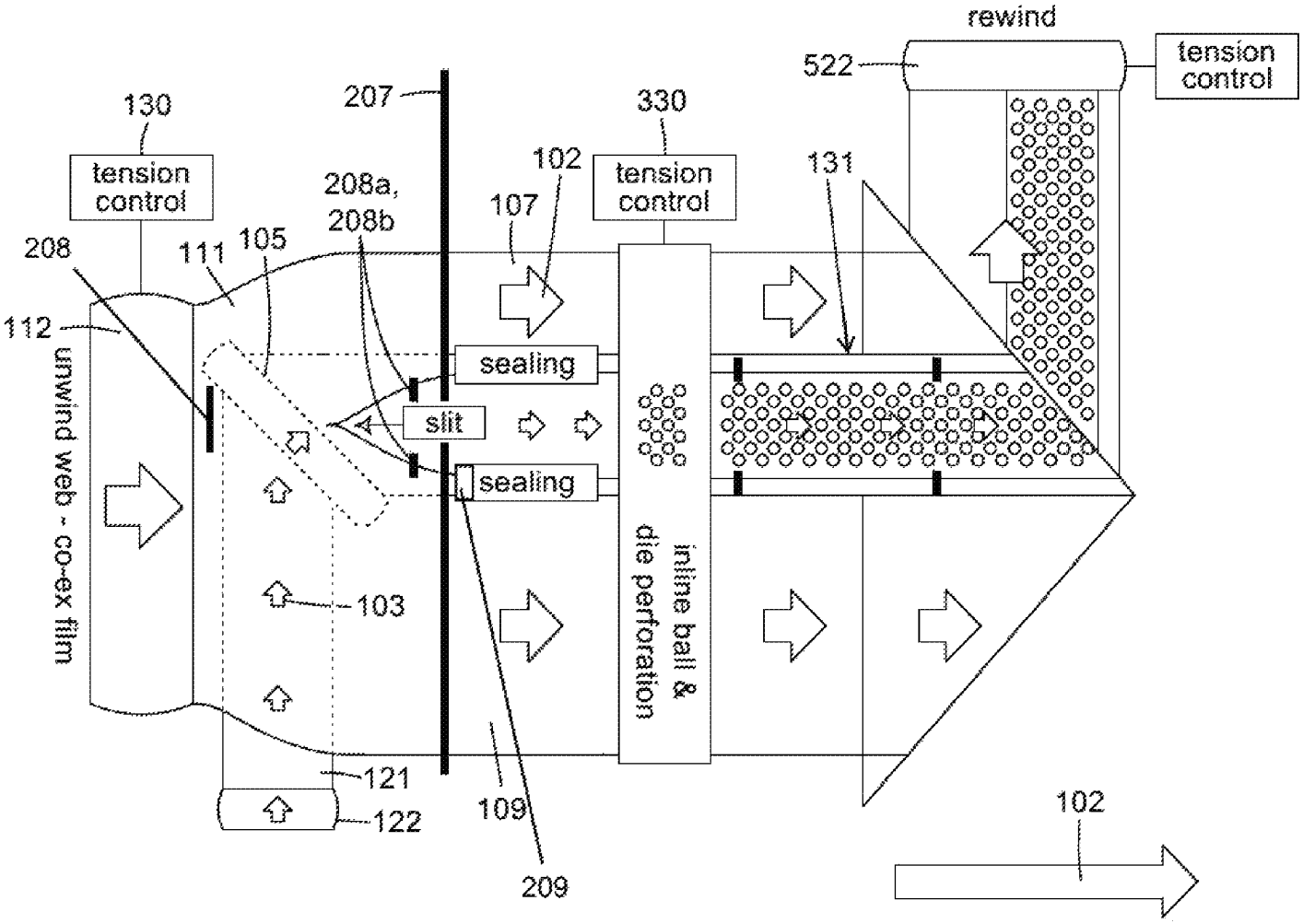
FIG. 4 is a schematic diagram of a process for manufacturing bag forming sheets, according to a possible embodiment.

Referring now to FIG. 4, a possible embodiment of the manufacturing process is illustrated. In this case, the continuous printable web has already been printed, and the continuous printed web 111 is provided in rolls 112.

Conveying Step (Step 200)

In some embodiments, the manufacturing process makes use of a control tension mechanism 130 to control the speed at which the printed web 111 is unrolled from the roll 112, and to control the tension applied to the printed web 111. The printed web 111 is unrolled along a first conveying direction 102, which in represented in FIG. 4 by a right arrow. It will be noted that in this embodiment, the conveying direction 102 is parallel to a longitudinal axis of the printed web 111 as it is conveyed along the continuous production line.

As will be described in more details below, the longitudinal axis of the printed web 111 can corresponds to either the transversal axis 23 or the longitudinal axis 21 of the bags 10 that will be formed with the manufacturing process.

The second continuous web 121 can also be provided in rolls, as shown by reference 122. The second continuous web 121 is unwound and can be conveyed along an intermediate conveying direction 103, which is perpendicular (or at any other angle) to the first conveying direction 102. In this case, the second continuous web 121 is then redirected so as to become aligned with the first conveying direction 102 with a transition roller 105 while being conveyed continuously. When reoriented, the second continuous web 121 may be subsequently inserted between two adjacent ones of the printed web sections. It will be understood that the transition roller 105 may be embodied by a plurality of components allowing redirecting a continuous web from one direction to another, as it is known in the art. In the illustrated embodiment, the second continuous web 121 is conveyed under the continuous printed web 111.

It is appreciated that, in an alternative embodiment, more than one second continuous web 121, made of similar or different materials, can be provided if the printed web 111 is cut into more than two printed web sections, as will be described in more details below. The second continuous web 121 can be cut into sections inserable between adjacent ones of the printed sections.

Alternatively, the second continuous web 121 can be unwound and conveyed immediately and continuously along the first conveying direction 102 without the need for a transition roller. In alternate embodiments, the flexible, second continuous web 121 could be conveyed above the printed continuous web 111.

The printed web 111 and the flexible, second continuous web 121 may be provided in the form of printed web roller 112 and second web roller 122, respectively. It will be understood that the printed web 111 and the second web 121 may however be provided by various means known by the one skilled in the art. For example, and without being limitative, the printed continuous web 111 and the second continuous web 121 can alternatively be provided as strips of variable length and width on a conveyor.

In the illustrated embodiment, the tension control mechanism 130 is provided to control a tension in the printed web 111 and/or the second continuous web 121. In some implementation, the tension is monitored by sensing means and a control feedback loop including a control unit. The control unit can be operatively connected to one or more actuators, such as driving rolls (or motors thereof), and to the sensing means. The control unit can be configured to control the actuators, for instance to adjust/vary the rotation speed of the one or more driving rolls (or motors thereof), based on input data received from the sensing means, thereby controlling the tension of the printed web 11.

For example, the sensing means may comprise a microwave system that is used to determine the diameter of printed web roll as it is being unwind. In such circumstances, the tension control mechanism may be configured so that the applied tension is adjusted/varied according to the diameter measured by the microwave system. In other words, the tension applied by the mechanism 130 may be in some cases function of the diameter of the printed web roll. Such mechanism or other contactless means may be advantageous, as they do not interfere with the printed web 111 as it is unwound.

In some embodiments, the control unit, e.g. a PLC, may be programmed with algorithms so as to apply a varying tamper tension to the sheet roller 112, according to the diameter, and also possibly according to the length of the roll. Of course, other tension control mechanisms may also be considered, such as a combination of a camera vision system interacting with a control unit, such as a PLC, or a servomotor.

Alternatively, the tension control mechanism 130 can make use of electrical means, friction systems, disc brakes, motors, or magnetic powder. It will be understood that the tension control mechanism 130 is embodied by a plurality of components allowing controlling the tension in the printed web 111 and may alter a rotation speed of the sheet roller 112 accordingly.

Printing Step (Step 150)

In the illustrated embodiment, the printing step 150 is performed prior to the unrolling step 100. The features are printed on the outer side of the printed web 111 with printing means that are known to one skilled in the art. As explained previously, not all of the surface of the printable web 111 need to be printed. After the printing step 150, the printed web 111 can either be rolled on a roller or conveyed continuously along the first conveying direction 102 (i.e. for the conveying step 200). In the first situation, i.e. wherein the printed is first rolled to be later unrolled, this step of the manufacturing process is not continuous, meaning that a step of the process may be performed outside an assembly line. Alternatively, the printed web 111 may first be provided unprinted. In this implementation, the printing step can be performed while continuously conveying the printable web, so that the process is fully in-line. In such circumstances, the printable web may be unrolled from the roller 112 and passed through a printing assembly for printing features with printing means known to one skilled in the art (not shown in FIG. 4). It will be understood that the printing assembly is embodied by a plurality of elements assembled together so as to print features on the flexible printable web, which can be for example a polyethylene film.

Cutting the Continuous Printed Web Step (Step 300)

The cutting step 300 is performed to separate the printed web 111 along the conveying direction 102 into at least two printed web sections. Generally, cutting the continuous printed web 111 comprises cutting the continuous printed web into n printed web sections and m of the printed web sections include printed features. Typically, at least two of the printed web sections comprises a portion of the printed features. As illustrated, the printed web 111 is separated into a first web section 107 and a second web section 109. In other embodiments, it is possible to cut the printed web in more than two web sections. For example, to create two window sections in the bags, the printed web would be cut into three web sections. In an embodiment, two or more of the web sections include a portion of the printed features. The printed web 111 can be cut with a cutting blade, along a direction that is parallel to the first conveying direction 102, so as to form the at least the two web sections 107, 109. Printed features of the printed web 111 are thus split between each of the web sections 107, 109.

Spacing Apart Step (Step 310)

The web sections 107, 109 are then spaced-apart by a predetermined distance, which can be adjusted/modified according to the size, dimensions and geometrical features of the second web 121 that is inserted between the printed web sections 107,109. As illustrated, after the step 310, the second continuous web 121 is inserted between adjacent printed web sections 107,109, which may be useful, for example, to create window(s) into the bag (if the second continuous web 121 is made of a substantially transparent material). In an embodiment, the predetermined distance is slightly shorter than a transversal dimension of the second web, so as to allow securing the web sections 107,109 to the second web 121 along longitudinal edges thereof.

Insertion Step and Maintaining Alignment Step (Step 315)

The spacing apart step 310 is followed by the insertion and maintaining the alignment step 315, in which the printed web sections 107,109 and the second web 121 are put in contact in view of a following securing step 320 along their respective adjacent longitudinal edges, to form the combined web 131, as it will be explained in greater detail below.

At this stage, the alignment of the web sections, in the illustrated embodiment the two web sections 107, 109 should be maintained at a same respective position along the conveying direction 102 (i.e. longitudinally), such that portions of the printed features, requiring relative alignment, are not shifted (one with respect to another), but remain aligned along the transversal axis 207. In other words, the printed features which were aligned along the transverse axis 207 on the printed web 111, before the cutting step 300, should remained substantially aligned following the cutting step 300 and prior to the securing step 320, i.e. they should not be displaced with respect to one another along the longitudinal axis, orthogonal to the transverse axis 207. Thus, the printed feature of the web section 107 should remained aligned with the printed features of the web section 109 along the transverse axis 207 following the cutting step 300. At the same time, the second web 121 is conveyed along the printed web 111 (in this case underneath the printed web 111), brought in close proximity of the web sections 107, 109 so as to seal adjacent ones of the outer longitudinal edges of the second web 121 and the inner longitudinal edges of the web sections 107,109.

The step of inserting the second continuous web 121 between the spaced-apart printed web sections comprises superposing the longitudinal adjacent edges (i.e. the outer edges) of the second continuous web 121 and the printed web sections 107,109 (i.e. their inner edges).

The continuous printed web 111, the printed web sections 107,109, the second continuous web 121, and the combined continuous web 131 are conveyed along the conveying direction at substantially a same conveying speed. Generally, the conveying speed is at least about 150 feet/minute, but could be slower if required by a targeted application. More particularly, the conveying speed can be comprised between 200 and 250 feet/minute. In some embodiments, the conveying speed is about 225 feet/min. It is to be noted that the conveying speed may vary as a result of a change of the rotation of speed of the pinch rollers, and so may be limited by the rotation speed of pinch rollers, as will be described in more details below.

In order to maintain the alignment of the web sections during this step of the process, it is possible, more precisely, to continuously monitor the speed and tension of the uncut printed web 111, and the respective speed and tensions of the web sections 107, 109 and to readjust the tensions and speeds of the web sections 107,109 one relative to the other. In some embodiments, the two web sections 107, 109 are maintained in alignment by modifying their respective tension and/or conveying speed one relative to the other by a tension control mechanism 330. According to a possible embodiment, the tension control mechanism 330 that allows keeping the web sections 107, 109 substantially aligned one relative to the other includes pinch rollers 209 associated to at least one of the web sections 107, 109. In some implementations, the pinch rollers 209 are operatively connected to and are controlled by servo drives or any other suitable control unit. For example, the displacement and/or tension applied on the web sections 107, 109 may be adjusted by controlling the rotation of the pinch rollers 209 or the friction applied (i.e. a force) by the pinch rollers.

Markers 208, also known as "eye marks", may be used as guides to indicate to each of the tension control unit, such as servo drives or other corresponding means or devices, whether one of the web sections 107,109 including a portion of the printed features requiring relative alignment should be slowed down or accelerated relative to the other web section (s) including also including a portion of the printed features requiring relative alignment. In the following, the expression "eye mark" is understood as referring to a reference mark, e.g. a mark, a sign, printed features, distinctive features or the like, which may be seen or detected by appropriate detection means or device(s) in order to facilitate alignment of the web sections 107,109 on either side of the second web 121. The eye marks are also sometimes referred to as "eye spots", and may be embodied, for example, by a small solid image. In another example, the eye marks may be in the shape of rectangular marks that are provided (e.g. printed) on a portion of the bags or the printed web 111. Alternatively, the eye marks may be embodied by dashed line, microdots, or similar structures.

As such, the eye mark may be useful to determine when to perform a step, e.g. when to cut, align and/or perforate some portions of the bags or the webs for forming the bags. The eye mark may be used in combination with an optical sensor for detecting the eye mark. After the detection of the eye mark by the optical sensor, some steps (e.g. the cutting step, the securing step and/or the perforating step) may be initiated.

In some implementations, the eye mark has a high contrast with respect to its environment (e.g. the eye mark is a black mark and the printed web 111 is white). In some embodiments, the eye mark may be placed in a "clear track", i.e. a location on the bag or the webs forming the bag and having no logo, no appreciable change in color, text, or the like. The eye mark may be printed (e.g. by a printer) before the cutting step 300 or upstream the entire process (e.g. during the step of printing features on the printable web to form a printed web 111, before conveying the printed web 111 along the conveying direction 112). In some embodiments, the eye mark may be placed so as to be non-visible (i.e. "hidden") once the bags are formed (e.g. beneath the seal, or the like). The eye mark(s) may be preprinted on the printed web 111 (or could alternatively be printed during the printing step 150) at specified intervals along the printed web.

In the illustrated embodiment, the eye mark 208 is divided into a master eye mark 208*a* and a slave eye mark 208*b*. The master eye mark 208*a* is provided on the web section 107, while the slave eye mark is provided on the web section 109. Alternatively, for example when the printed web 111 is divided into more than two web sections, the first web section includes the master eye mark, while the others each includes a slave eye mark. While there may be more than one slave eye marks, the slave eye marks are typically associated to only one master eye mark. During the step of maintaining the alignment between the web sections 107, 109, the tension into the web section 109 may be adjusted by the corresponding pinch rollers 209 so as the slave eye mark 208*b* remains aligned with the master eye mark 208*a*. As such, the pinch rollers 209 can be located downstream of the cutting blades performing the cutting step 330, but upstream of the sealing mechanism used to secure the longitudinal edges of the second web 121 to the printed web sections 107, 109.

In an embodiment, only the printed web sections including a portion of the printed features requiring relative alignment include an eye mark. In another embodiment, all printed web sections include an eye mark.

Maintaining the alignment of the printed sections generally comprises detecting a position of the master eye mark 208*a* and the at least one slave eye mark 208*b*, comparing the position of the at least one slave eye mark 208*b* with the position of the master eye mark 208*a* and, if needed, adjusting/varying/controlling the position of the at least one slave eye mark 208*b* to be aligned with the master eye mark 208*a* along the conveying direction 102. In some embodiments, adjusting the position of the at least one slave eye mark 208*b* comprises adjusting/modifying a rotation speed of the pinch rollers 209 engaging the respective one of the printed web sections 107,109 including the at least one slave eye mark 208*b* which relative position should be adjusted/corrected. As illustrated in FIG. 4, the pinch rollers 209 are engaged with the printed section 109. Alternatively, the pinch rollers 209 could be engaged with the printed section 107, or could even be engaged with both the printed web sections 107,109.

In some embodiments, the master and slave eye marks 208*a*, 208*b* can be detected, for example with a vision system (e.g. comprising a photocells assembly) or an encoder, and used as feedback signals feed to the servo drives to readjust the tension and/or speed of the web sections 107,109. The markers 208*a*, 208*b* could also be part of the printed features. For example, since the same design is continuously repeated on the printed web 111, a specific detail in the design could be used as a marker, and a vision system (or other inspection system, such as a laser system) can be used to continuously detect the position of the specific detail, and readjust in real-time the respective tensions applied to the web sections 107,109, to prevent drifting of one web section 107 relative to the other 109. Of course, the markers 208*a*,208*b* can also be located elsewhere, such at the edges of the printed web 111, as long as they can be detected by a sensor or other mechanism such that the tension applied to each web sections 107,109 is adjusted based on the position of their corresponding markers 208*a*, 208*b*.

In an embodiment, the printed web 111 includes a plurality of longitudinally spaced-apart reference/eye marks. The distance between two consecutive ones of the reference/eye marks can be determined such that each one of the bag forming sheets 20 includes one of the reference/eye marks. Thus, each one of the reference/eye marks can be indicative of a new bag forming sheet 20 that will be cut into the combined continuous web 131.

The printed web 111 includes a plurality of longitudinally spaced-apart reference marks 208 along its longitudinal axis and, when cutting the continuous printed web 111, each one of the reference marks 208 can be cut into a master eye mark 208*a* localized on the first one of the printed web sections including printed features and at least one slave eye mark 208*b* wherein each one of the slave eye mark is localized on another one of the printed web sections including printed features and requiring relative alignment. As mentioned above, in some implementations, printed web sections which are free of printed features or which include printed features that do not require relative alignment can also include reference/eye marks. Similarly, the printed web sections including printed features that do not require alignment can be free of reference and/or eye mark.

In an embodiment, wherein the printed web 111 is cut into n printed web sections, wherein m of the printed web sections include printed features requiring alignment. In an embodiment, at least m−1 of the printed web sections should include slave eye marks. Furthermore, the m−1 of the printed web sections including printed features requiring alignment should be engaged between pinch rollers while they are being conveyed to be adjustable in tension and thereby maintain/adjust/correct alignment of their respective printed feature portions.

It is to be noted that the step of maintaining/adjusting/correctings the alignment of the printed sections 107, 109 is performed while the printed sections 107,109 are conveyed continuously along the conveying direction 102.

Securing Step (Step 320)

Still referring to FIG. 4, the securing mechanism is located downstream of the alignment mechanism. The securing mechanism can comprise a rotary band sealer that produce hermetic seals along both edges of the second web 121

Securing the second continuous web 121 to the spaced-apart printed web sections 107,109 along longitudinal adjacent edges may for example comprise heat sealing the spaced-apart printed web sections to the second continuous web along the longitudinal adjacent and superposed edges. It will be readily understood that other means for securing the second web 121 to the printed web sections 107,109 could have been used. For example, securing the edges of the second web 121 and the printed web sections 107,109 could be achieved by thermofusion, heat-welding, laser processing or stitching.

Perforating Step (Step 400)

Still referring to FIG. 4, in a non-limitative embodiment, perforations are made in at least one of the second continuous web 121 and the printed web sections 107,109 of the combined continuous web 131. The perforations can be made with a punching assembly known in the art. The punching assembly typically comprises ball punches associated with a die. The die is located under the first continuous web 111. The ball punches cooperate with the die to produce the perforations on the first continuous web 111. Other perforating ways are possible, and in other embodiments, perforations can be made in the transparent and/or in the printed webs.

The perforations can be performed in accordance with a predetermined perforation pattern to ensure that no perforation is formed at a junction of two segments, i.e. either where the printed web sections 107,109 are secured to the second continuous web 121 or where the edges of the bag forming sheets 20 will be secured to form the bag 10.

In some embodiments, the predetermined perforation pattern may have a length (i.e. a dimension extending along the conveying direction 102) which is smaller than the distance between two consecutive ones of the reference/eye marks, taken along the conveying direction 102.

Perforating at least one of the second continuous web 121 and the printed web sections 107,109 may include detecting at least one of the master eye mark 208*a* and the at least one slave eye mark 208*b*. This step also includes beginning perforation of the at least one of the second continuous web 121 and the printed web sections 107,109 in accordance with a predetermined perforation pattern after at least one of a predetermined period of time and a predetermined spacing following detection of the at least one of the master eye mark and the at least one slave eye mark. It is to be noted that the step of conveying the continuous printed web along the conveying direction (step 200) is performed at a conveying speed, and that the process may further includes adjusting at least one of the predetermined period of time and the predetermined spacing in accordance with the conveying speed.

Thus, if the position of the reference mark 208 (either the master eye mark 208*a* or the slave eye mark(s) 208*b*) is associated to a beginning of a new bag forming sheet 20, the perforation pattern should begin at a predetermined distance from an eventual sealing line. Similarly, it should end at a predetermined distance from another possible sealing line.

It is appreciated that an eye mark detection unit similar to the one described above to maintain/adjust alignment of the printed features on the printed web sections 111 can be used to the detect the at least one of the master eye mark 208*a* and the at least one slave eye mark 208*b* to determine when beginning the perforation pattern.

Cutting Transversally the Combined Continuous Web Step and Forming the Bags Step (Step 500)

The step of perforating the printed web sections or the second continuous web may be followed by a step of cutting transversally the combined continuous web to define bag forming sheets 20. This step may be performed while continuously conveying the combined continuous web.

Once again, the cutting step may be performed once at least one of the master eye mark 208*a* and the at least one slave eye mark 208*b* is detected since each one of the longitudinally spaced-apart reference mark can be associated to a bag forming sheet 20. If the cutting step is carried out once at least one of the master eye mark 208*a* and the at least one slave eye mark 208*b* is detected, the system can include an eye mark detection unit similar to the one described above to maintain/adjust alignment of the printed features on the printed web sections 111.

In the embodiment illustrated in FIG. 4, the combined web 131 is not formed into bags on a continuous line. The combined web 131 is rewound on a rewind roller 522 in a step 510 of rewinding the combined web 131. The rolled combined web can be transported to another assembly line to be cut into bag forming sheets 20 and then formed into bags.

Alternatively, the assembly of the bags can be made in a continuous process. In this case, forming the bags includes folding the bag forming sheets 20 to create the bottom edge 44 or one of the two longitudinal edges 46A, 46B of the bags, and securing what will become the longitudinal edges of the bags or the bottom edge 44 and the other one of the two longitudinal edges 46A, 46B of the bags. Securing the edges can be made by heat sealing, a step which can also separate the bags. It is also possible to first cut the combined web 131 into individual bag forming sheets 20, such as shown in FIGS. 5 and 6. With reference with FIG. 5, the bag forming sheet 20 may be folded along the bottom edge 44 and sealed along the longitudinal edges 46A, 46B to form the bag 10. Securing the longitudinal edges 46A, 46B of the bag can be made through heat welding. The bag 10 thus has an open mouth 26 extending along the top edge 42 and is closed at the longitudinal edges 46A, 46B. It will be understood that the heat welding step can be replaced by other methods that are well known in the art, such as thermofusing, laser processing or stitching.

In an alternative embodiment (not shown), the bag forming sheet 20 may be folded along one of the longitudinal edges 46A, 46B and sealed along the bottom edge 44 and the other one of the longitudinal edges 46A, 46B to form the bag 10. Once again, the bag 10 thus has an open mouth 26 extending along the top edge 42 and is closed at the longitudinal edges 46A, 46B.

It is appreciated that the longitudinal axis 21 of the bag 10 may or may not correspond to the longitudinal axis of the combined continuous web 131, i.e. the conveying direction 102.

According to yet another possible option, the combined web 131 can be cut in bag forming sheets that will form only one of the front and/or back walls of the bag 10. The cut sheets made from the combined web 131 can be combined with an additional sheet, and sealed along the bottom and longitudinal edges 44, 46A, 46B to form the bag 10.

Forming bags with the bag forming sheets may be performed by folding the bag forming sheets and securing together at least two pairs of superposed free edges of the folded bag forming sheets. In this scenario, each one of the bags includes at least one second web 121 portion extending between two printed web sections 111, the portions of the printed features being aligned on each side of the second web section (i.e. with substantially the same alignment that the printed features prior to the cutting step 300).

As can be appreciated, the manufacturing process described above allows maintaining alignment of printed features provided on both sides of (a) second web segment (s) (which can be window(s) formed in the bags) such as those used in the food industry. In addition, it allows providing consistency of the manufactured bags, ensuring that the bags made with the in-line process are almost identical.

Perforations Implementations

In some embodiments, the manufacturing process may be used to produce bags without aligned printed features, such as the one illustrated in FIG. 6. In this context, the process includes, amongst others, the steps of conveying a first continuous web along a conveying direction; cutting the first continuous web along the conveying direction into first web sections; spacing apart the first web sections; inserting a second continuous web between adjacent ones of the spaced-apart first web sections and securing the second continuous web to the spaced-apart printed web sections along longitudinal adjacent edges to form a combined continuous web including a plurality of reference marks spaced-apart along the conveying direction. These steps are similar to the one described above.

To perform the perforations in the combined web 131, the process further includes detecting the reference marks (which can be a master eye mark or a slave eye mark if the combined continuous web includes a plurality of eye marks); and beginning perforation of the combined continuous web in accordance with a predetermined perforation pattern after at least one of a predetermined period of time and a predetermined spacing following detection of the reference marks. Either continuously or as a separate manufacturing step the process can further include cutting transversally the combined continuous web to define bag forming sheets.

As described above, the perforations can be performed in accordance with a predetermined perforation pattern to ensure that no perforation is formed at a junction of two segments, i.e. either where the first web sections are secured to the second continuous web or where the edges of the bag forming sheets 20 will be secured to form the bag 10. As it will be appreciated, having perforations within the junction of two segments would weaken the resulting bag 10. Thus, if the position of the reference mark is associated to a beginning of a new bag forming sheet 20, the perforation pattern should begin at a predetermined distance from a possible sealing/securing line. Similarly, it should end at a predetermined distance from another possible sealing/securing line.

It is appreciated that an eye mark detection unit similar to the one described above to maintain/adjust alignment of the printed features on the printed web sections can be used to the detect the reference mark to determine when beginning the perforation pattern.

Of course, this example of embodiment can be combined with the other embodiments or alternative thereof. More particularly, this embodiment may be combined with other implementations of the manufacturing process or some steps of the manufacturing process which have been previously described, depending on the targeted needs of a user.

First Continuous Web and Second Continuous Web Implementation

A non-limitative example of a process for manufacturing bags on a continuous production line may be performed as follows. Broadly, the process according to this implementation allows manufacturing bag(s) with at least one of the bag forming sheets obtained during the process.

In a first step, a first continuous printed web is conveyed along a conveying direction. The first continuous printed web includes a plurality of spaced-apart master eye marks. Then, a second continuous web is conveyed along the conveying direction. The second continuous web includes a plurality of spaced-apart slave eye marks. The process according to this implementation also includes a step of detecting a position of one of the master eye marks and one of the slave eye marks. The position of the detected one of the slave eye marks is compared with the position of the detected one of the master eye marks and, if needed, the position of the detected one of the slave eye marks is adjusted to be aligned with the detected one of the master eye marks along the conveying direction. The second continuous web is then secured to the first continuous printed web along longitudinal adjacent edges, thus forming a combined continuous web.

In some embodiments, adjusting the position of the detected one of the slave eye marks comprises adjusting respective tension applied to the second continuous web while being conveyed along the conveying direction. For example, adjusting the respective tension applied to the second continuous web may further comprise engaging the second continuous web between pinch rollers and controlling a rotation speed of the pinch rollers.

In some embodiments, the process may further comprise a step of cutting transversally the combined continuous web to define bag forming sheets. This step may be followed by a step of forming bags with the bag forming sheets by folding the bag forming sheets and securing together at least two pairs of superposed free edges of the folded bag forming sheets. After this step, the bags are formed, and each one of the bags includes a second web portion secured to a first web portion.

Example of Implementation

An example of the manufacturing process described herein may be performed as follows. First, the flexible and printed continuous web having the first opacity degree is conveyed along the conveying direction. The flexible and printed continuous web is then cut along the longitudinal axis, which is extending parallel to the conveying direction, to form the at least two printed web sections. Each one of the at least two printed web sections has a longitudinal inner edge. As such, each one of the at least two printed web sections include a portion of the printed features which should remain substantially aligned with respect to one another. The at least two printed web sections are spaced-apart while the alignment between the at least two printed web sections along the conveying direction is maintained. The flexible and transparent continuous web may then be inserted between the at least two spaced-apart printed web sections while the alignment between the at least two printed web sections along the conveying direction is still maintained. As previously mentioned, the flexible and transparent continuous web sheet has a second opacity degree, less opaque than the first opacity degree. The longitudinal edges of the flexible and transparent continuous web are subsequently secured to a respective one of the longitudinal inner edges of the at least two spaced-apart printed web sections to form the combined continuous web. The following steps are thereafter performed to form the bag. First, either online or offline, the combined continuous web is transversally cut to define the bag forming sheets, which are later folded. The at least two pairs of superposed free edges of the folded bag forming sheets are then secured one to another.

When manufactured according to this example of manufacturing process, each one of the bags has a front wall and a back wall, a top edge, an opposed bottom edge and two spaced-apart longitudinal edges extending between the top and the bottom edges, as it has been previously presented. Each bag also has an open mouth extending along the top edge, and is closed along the bottom and longitudinal edges.

Once the bag is formed, the front and the back walls may include printed bag sections made from the at least two printed web sections. At least one of the front and back walls may include one or more windows made from the flexible and transparent continuous web, with portions of the printed features on the printed bag sections being aligned on each side of the one or more windows.

It is appreciated that features of one of the above described embodiments can be combined with the other embodiments or alternative thereof. More particularly, the example of implementation just described may be combined with other implementations of the manufacturing process, depending on the targeted needs of a user.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A process for manufacturing bags, the process comprising steps of:

conveying continuously a flexible and printed continuous web having a first opacity degree along a conveying direction, the flexible printed continuous web having printed features in an original configuration;

while being conveyed along the conveying direction, cutting the flexible and printed continuous web along a longitudinal axis, extending parallel to the conveying direction, to form at least two printed web sections, each one of the at least two printed web sections having at least one longitudinal inner edge, at least two of the printed web sections including a portion of the printed features requiring relative alignment;

spacing apart the at least two printed web sections while maintaining an alignment between the at least two printed web sections along the conveying direction by adjusting a tension applied to at least one of the at least two printed web sections;

inserting a flexible and transparent continuous web between adjacent ones of the at least two spaced-apart printed web sections while maintaining the relative alignment between the at least two printed web sections including the portion of the printed features requiring relative alignment along said conveying direction by adjusting a tension applied to at least one of the at least two printed web sections, the flexible and transparent continuous web sheet having a second opacity degree, less opaque than the first opacity degree; and securing longitudinal edges of the flexible and transparent continuous web to a respective one of the longitudinal inner edges of the adjacent spaced-apart printed web sections to form a combined continuous web, wherein the portions of the printed features of the at least two printed web sections located on a respective side of the flexible and transparent continuous web are aligned one with another according to the original configuration;

wherein spacing apart the at least two printed web sections, inserting the flexible and transparent continuous web, and securing the longitudinal edges of the flexible and transparent web occur while the web is being conveyed;

then, cutting transversally the combined continuous web to define bag forming sheets;

folding the bag forming sheets; and securing together at least two pairs of superposed free edges of the folded bag forming sheets to form a bag, the bag having a front wall and a back wall, a top edge, an opposed bottom edge and two spaced-apart longitudinal edges extending between the top and the bottom edges, the bag having an open mouth extending along the top edge and being closed along the bottom and longitudinal edges, the front and the back walls including printed bag sections, at least one of the front and back walls including one or more windows made from the flexible and transparent continuous web, with portions of the printed features on the printed bag sections being aligned on each side of the one or more windows.

2. The process according to claim 1, wherein adjusting the tension applied to the at least one of the printed web sections including printed features while being conveyed along the conveying direction is performed before securing the flexible and transparent continuous web to the at least two spaced-apart printed web sections.

3. The process according to claim 1, wherein a first one of the at least two printed web sections including printed features comprises a master eye mark and each one of the others printed web sections including printed features comprise a slave eye mark.

4. The process according to claim 3, wherein maintaining the alignment of the at least two printed sections comprises detecting a position of the master eye mark and the at least one slave eye mark, comparing the position of the at least one slave eye mark with the position of the master eye mark and, if needed, adjusting the position of the at least one slave eye mark to be aligned with the master eye mark along the conveying direction.

5. The process according to claim 3, wherein the flexible and printed continuous web comprises a plurality of longitudinally spaced-apart reference marks and wherein cutting the flexible and printed continuous web comprises cutting the reference mark into the master eye mark localized on the first one of the at least two printed web sections including printed features and the at least one slave eye mark, each one being localized on another one of the at least two printed web sections including printed features.

6. The process according to claim 4, wherein detecting the position of the master eye mark and the at least one slave eye mark is performed with an eye mark detection unit comprising a photocells assembly.

7. The process according to 4, wherein adjusting the position of the at least one slave eye mark comprises adjusting a rotation speed of the pinch rollers engaging the respective one of the printed web sections including the at least one slave eye mark.

8. The process according to claim 5, further comprising printing the plurality of reference marks at predetermined intervals along the flexible and printed continuous web before cutting the flexible and printed continuous web.

9. The process according to claim 1, further comprising perforating at least one of the flexible and transparent continuous web and the at least two printed web sections of the combined continuous web.

10. The process according to claim 9, wherein perforating at least one of the flexible and transparent web and the at least two printed web sections comprises:

detecting at least one of the master eye mark and the at least one slave eye mark; and beginning perforation of the at least one of the flexible and transparent continuous web and the at least two printed web sections in accordance with a predetermined perforation pattern after at least one of a predetermined period of time and a predetermined spacing following detection of the at least one of the master eye mark and the at least one slave eye mark.

11. The process according to claim 10, wherein the step of conveying continuously the flexible and printed continuous web along the conveying direction is performed at a conveying speed, the process further comprising adjusting the at least one of the predetermined period of time and the predetermined spacing in accordance with the conveying speed.

12. The process according to claim 11, wherein the conveying speed is at least about 150 feet/minute.

13. The process according to claim 1, wherein the flexible and continuous web, the at least two printed web sections, the flexible and transparent web, and the combined continuous web are conveyed along the conveying direction at substantially a same conveying speed.

* * * * *